United States Patent [19]

Mattox

[11] Patent Number: 4,563,004

[45] Date of Patent: Jan. 7, 1986

[54] FRICTION TYPE ISOKINETIC EXERCISE MECHANISM

[76] Inventor: Ernest M. Mattox, 3008 House Ct., NE., Belmont, Mich. 49306

[21] Appl. No.: 434,739

[22] Filed: Oct. 18, 1982

[51] Int. Cl.[4] ..... A63B 21/00

[52] U.S. Cl. ..... 272/131; 188/67

[58] Field of Search ..... 272/131, 137, 142, 67, 272/68; 188/65.1, 67

[56] References Cited

U.S. PATENT DOCUMENTS

| | | | |
|---|---|---|---|
| 767,008 | 8/1904 | Pelletier et al. | 272/130 |
| 2,307,856 | 1/1943 | Porter | 272/131 |
| 2,621,043 | 12/1952 | Olmstead | 272/131 |
| 3,174,343 | 3/1965 | Kasulis | 272/130 X |
| 3,190,648 | 6/1965 | Kallenbach | 272/79 |
| 3,343,837 | 9/1967 | Grzybowski | 272/137 |
| 3,424,280 | 1/1969 | Hettich | 188/67 |
| 3,471,145 | 10/1969 | Berger | 272/130 |
| 3,589,720 | 6/1971 | Agamian | 272/80 |
| 3,596,907 | 8/1971 | Brighton | 272/131 |
| 3,637,205 | 1/1972 | Bankston | 272/68 |
| 3,971,255 | 7/1976 | Varney et al. | 272/131 X |
| 4,208,049 | 6/1980 | Wilson | 272/138 |
| 4,249,725 | 2/1981 | Mattox | 272/117 |
| 4,257,315 | 3/1981 | Tisell et al. | 188/67 X |
| 4,457,741 | 7/1984 | Hoeptner, III | 188/67 X |

FOREIGN PATENT DOCUMENTS

| | | | |
|---|---|---|---|
| 2057276 | 4/1981 | United Kingdom | 272/131 |

*Primary Examiner*—Richard J. Apley
*Assistant Examiner*—William R. Browne
*Attorney, Agent, or Firm*—Varnum, Riddering, Schmidt & Howlett

[57] ABSTRACT

An isokinetic muscular exercise mechanism for the human body having an elongated tubular rail (14), a tubular slide member (20) mounted on the rail for sliding movement therealong, and a brake (32) mounted within the tubular slide member adapted to provide substantially higher frictional resistance to sliding movement of slide member in one linear direction along the rail than in the opposite direction thereof. The brake also provides a frictional resistance directly proportional to the linear force applied to the slide member in the one direction. A handle (16) is formed on one end of the tubular rail (14) and another handle (21) is provided on the slide member (20) to permit the device to be gripped by the hands of the user. The device is relatively small, simple and portable.

11 Claims, 2 Drawing Figures

FRICTION TYPE ISOKINETIC EXERCISE MECHANISM

FIELD OF THE INVENTION

This invention relates to exercise mechanisms. In one of its aspects, the invention relates to a hand-held isokinetic muscular exercise mechanism for the human body in which the reactive force is directly proportional to the force applied by the user.

STATE OF THE PRIOR ART

Many different forms of exercise equipment have been developed over many years. Different devices have been designed to strengthen different muscles. Many of these devices use weights, springs or preset resistance to movement, all of which require the user to use only that amount of strength necessary to move the device through the weakest part of any movement. Such devices do not allow one to work at his or her maximum capabilities during that portion of movement in which the user has higher strength capabilities.

Thus, it has been recognized that exercise equipment should offer resistance at a level which adapts automatically to the user's abilities and desires throughout the entire range of the exercising stroke. This equipment is known as "isokinetic" exercising equipment. With this equipment, the user's strength is taxed to the same extent throughout the entire length of the exercising stroke, notwithstanding different strength capabilities in different portions of the stroke. Further, the amount of resistance generated by the equipment is tailored to the physical characteristics of the user simply by virtue of the amount of energy imparted to the equipment by the user.

Several isokinetic exercise devices have been developed. Some of these devices are complex and, accordingly, are costly, have required frequent maintenance, are large and fixed in location. As presently advised, no isokinetic devices are portable or can be handheld or movable easily from place to place or are otherwise especially suitable for paraplegics. Examples of such prior art isokinetic devices are those devices disclosed and claimed in my U.S. Pat. No. 4,249,725, issued Feb. 10, 1981, and in my copending U.S. patent application Ser. No. 071,062 filed Aug. 30, 1979, and entitled ISOKINETIC EXERCISER, now U.S. Pat. No. 4,385,760 issued May 31, 1983.

SUMMARY OF THE INVENTION

According to the invention, an isokinetic muscular exerciser for the human body comprises an elongated rail, a slide member mounted on the rail for sliding movement therealong and a brake means on the slide member adapted to provide substantially higher frictional resistance to sliding of the slide member in one direction along the rail than in an opposite direction thereof. The brake means provides frictional resistance to movement of the slide member directly proportional to the linear force applied and to the slide member in the one direction.

The rail is preferably provided with a handle grip, which can be formed by bending an end portion of the rail at right angles to the main portion thereof. Also, a handle grip is preferably provided on the slide member. The slide member handle grip can be a depending tubular member which is positioned perpendicular to the direction of movement of the slide member along the rail.

The slide member is preferably tubular in shape and bearings are provided on the ends of the slide member, the bearings conforming to the cross-sectional shape of the rail to guide the tubular slide member along the rail. In a preferred embodiment of the invention the rail is also tubular shaped.

The brake means preferably comprises a friction-generating washer mounted within the tubular slide and a ramp means in bearing relationship against the washer so that as the slide is moved in one direction, the washer is forced along the ramp to compress the washer against the rail. In a preferred embodiment of the invention, the ramp comprises a conical surface formed in a collar positioned within the slide member.

Occasionally it is desirable to change the frictional resistance of the slide member along the rail. To this end, means are mounted on the rail for selectively reducing the coefficient of friction between the rail and the slide member. This friction-reducing means can be any suitable washer or ring impregnated with a lubricating agent, preferably a solid lubricating agent.

BRIEF DESCRIPTION OF THE DRAWINGS

The invention will now be described with reference to the accompanying drawings in which.

DESCRIPTION OF THE PREFERRED EMBODIMENT

Figure 1:
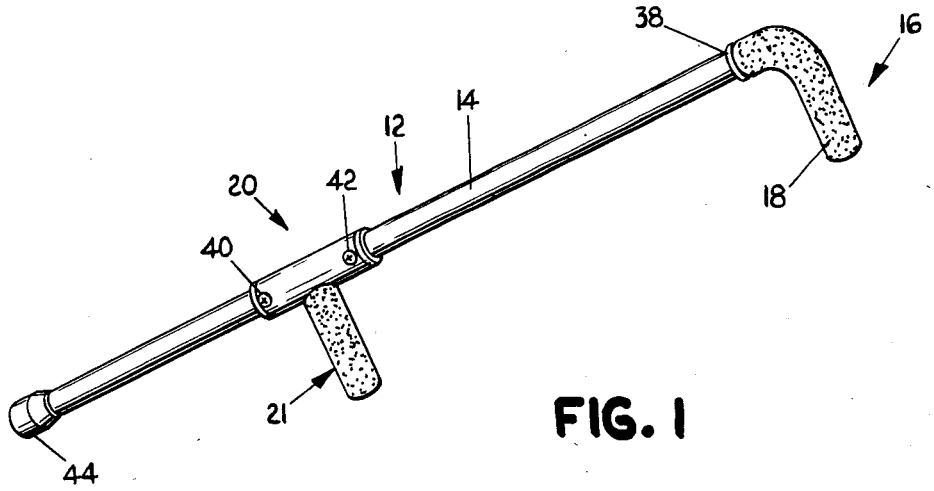
FIG. 1 is a plan view of a kinematic slide mechanism according to the invention.

Referring now to the drawings, and to FIG. 1 in particular, there is shown a kinematic slide mechanism 12 formed of an elongated tubular rail 14, one end of which is bent at right angles to form a handle 16 having a rubber covering 18. A slide member 20 having a handle 21 is mounted for sliding movement along the length of the tubular rail 14. An annular lubricating washer 38 is slidably mounted on the tubular rail 14 between the handle 16 and the slide member 20. The lubricating washer can be any suitable material having a lubricating material, preferably a solid lubricating material, impregnated therein. An example of a suitable lubrication impregnated material is a leather washer having a solid lubricating material therein designated 207 waterproof washer and sold by C. W. Marsh Company, 1385 Hudson Street, Muskegon, Mich. The washer 38 fits snugly on the tubular rail 14 so that it can slide along the tubular member and provide lubrication thereto.

A rubber tip 44 is provided on the end of the tubular rail 14 so that the tubular rail 14 can be placed against a surface such as a floor or wall.

Figure 2:
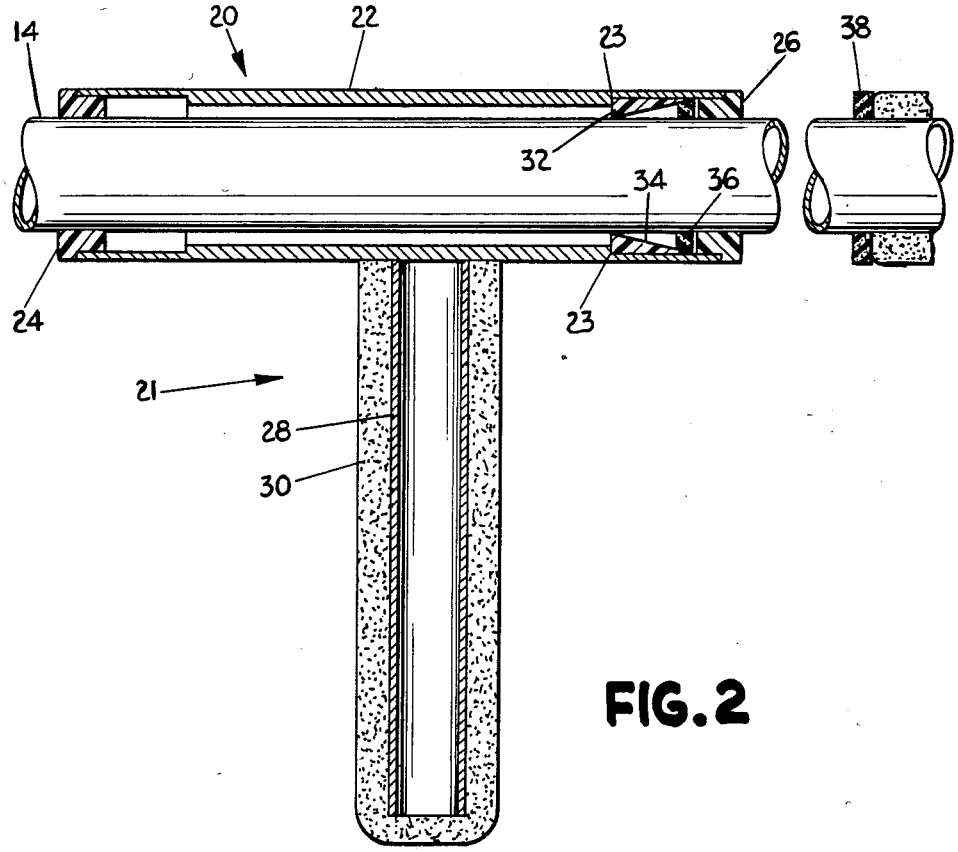
FIG. 2 is an enlarged cross-sectional plan view of a portion of the slide mechanism shown in FIG. 1.

Referring now to FIG. 2, the slide member 20 comprises a tubular member 22 which is concentric with the axis of the tubular rail 14. As illustrated in FIG. 2, the inner diameter of the tubular member 22 is larger than the outer diameter of the tubular rail 14 so that an annular space is provided therebetween. An annular shoulder 23 is found in the inter surface of the tubular member 22. The tubular member 22 is supported on the tubular rail 14 by a pair of annular frictionless bushings 24 and 26 which are maintained on the tubular member 22 through a pair of set screws 40 and 42 (FIG. 1). Any suitable means such as staking or adhesives can also be used to secure the bushings 24 and 26 to the tubular member 22.

The handle 21 comprises a tubular handle member 28 which is welded to the tubular member 22. A rubber covering 30 is bonded to the tubular handle 28 to provide a firm gripping surface.

A brake mechanism 32 is mounted within the tubular member 22, adjacent to the frictionless bushing 26 and in abutting relationship with shoulder 23. The brake mechanism 32 comprises an elongated annular bushing, preferably made of plastic and having an internal ramped or conical surface 34. An annular leather washer 36 is slidably mounted on the tubular rail 14 and fits within the very end of the annular brake member 32. The inner diameter of the leather washer 36 is only slightly smaller than the outer diameter of the tubular rail 14 so that there is some frictional resistance between the washer 36 and the tubular rail 14. Any suitable leather or synthetic washer can be used. An example of a suitable washer is a 616 Thiokal washer sold by the C. W. Marsh Company of Muskegon, Mich.

In operation, the user grips the handle 21 and the handle 16 and pulls the two units towards each other. The rubber covering on the handles 16 and 21 provide a secure gripping surface. As the units are pulled towards each other, the frictional resistance between the washer 36 and the tubular rail 14 causes the washer 36 to ride up on the ramp 34, thereby increasing the frictional resistance between the washer 36 and the tubular rail 14. The extent of movement of the washer 16 and the extent of frictional forces between the washer 36 and the tubular rail 14 depend on the force applied between the handle 21 and the handle 16. In other words, the harder the force, the greater the frictional resistance of the slide member. Thus, the slide member 20 provides a varying kinematic resistance to movement along the tubular rail 14, the amount of frictional resistance being dependent on the amount of force applied to the slide 20 with respect to the tubular rail 14.

On the other hand, movement of the slide member 20 away from the handle 16 moves the washer 36 into abutting relationship with the guide member 26. In this position of the washer 36 with respect to the ramp 34, little or no frictional resistance is applied by the washer 36 on the tubular rail 14. Thus, movement of the slide away from the handle is relatively frictionless whereas movement of the slide toward the handle 16 provides a variable isokinetic resistance to movement of the slide 20 toward the handle 16.

In the event that it is desirable to reduce the frictional resistance between the slide 20 and the elongated tubular rail 14, the annular lubricating washer 34 is moved along the length of the tubular rail 14 to lubricate the surface thereof. This lubrication reduces the coefficient of friction between the leather washer 36 and the tubular rail 14. If the frictional resistance is too low, the lubrication can be wiped off with a cloth.

The slide mechanism is versatile in that it can be used in many different exercises. The most obvious method is to place the mechanism horizontally in front of the user and pull the handles toward each other, for upper pectoral flexing. It can also be put behind the head for overhead flexing. Further, it can be placed vertically for a pulling or rowing action when the user is bent over or with a pulling action when the user is seated. The unit can be placed laterally to one side of the user for a throwing motion, it can be used with the handle on the knee and the unit in vertical position for a toe-raising operation. It can be used horizontally behind the back for back and arm flex. The unit can be placed laterally of the body at about waist position for a tennis forehand flex. The rubber tip can be placed against a wall with the handle against the midportion of the body to provide an arm-curl exercise with the user pulling the handle 21 toward him or her. Various other types of muscle exercises can be devised.

The invention thus provides a single, but very effective device for strengthening and exercising many different body muscles. Since the mechanism can be used with just two arms and requires no special position, it is especially suitable for paraplegics.

Whereas the invention has been described with reference to a slide member 20 having a handle 21, it is within the scope of the invention to have other forms of a handle, or no handle depending from the tubular member 22. On can simply grip the tubular member 22 and the handle 21 can be eliminated.

Whereas the brake mechanism 32 has been described with reference to a washer 36 and a ramp 34, a brake within the scope of the invention can also be provided with a series of balls within a ramp like ramp 34, or by a conical sleeve with a surface complementary to ramp 34.

Reasonable variation and modification are possible within the scope of the forgoing description and drawings without departing from the spirit of the invention.

The embodiments of the invention in which an exclusive property or privilege is claimed are defined as follows:

1. An exercise mechanism comprising:

an elongated rail;

a slide member mounted on said rail for sliding movement therealong; and brake means on said slide member for frictionally resisting the movement of said slide member on said rail by a user, said brake means comprising a friction generating washer on said rail, ramp forming means in bearing relationship with said friction generating washer for transferring a component of a user's force on said slide member to said friction generating washer, said component of force being perpendicular to the axis of said rail and proportional to the force applied by a user to said slide member, whereby said brake means is adapted to provide frictional resistance to the movement of said slide member along said rail in direct proportion to the linear force applied to said slide member.

2. An exercise mechanism according to claim 1 and further comprising an end portion on said rail bent at right angles to the main portion of said rail forming a handle grip.

3. An exercise mechanism according to claim 2 and further comprising means on said slide member forming a handle grip.

4. An exercise mechanism according to claim 3 wherein the frictional resistance of said brake means is directly proportional to the linear force applied to said slide member in said one direction.

5. An exercise mechanism according to claim 4 wherein said slide member is tubular in shape and further comprises cylindrical bearings at each end of said slide member, which cylindrical bearings conform to the cross-sectional shape of said rail to guide the tubular slide member along the rail.

6. An exercise mechanism according to claim 1 wherein said slide member is tubular in shape and further comprising annular bearings at each end of said slide member which annular bearings conform to the cross-sectional shape of the rail to guide the tubular slide member along the rail.

7. An exercise mechanism according to claim 1 wherein said ramp-forming means comprises a conical surface.

8. An exercise mechanism according to claim 1 and further comprising means mounted on said rail for selectively reducing the coefficient of friction between the rail and the slide member.

9. An exercise mechanism according to claim 8 wherein said coefficient of friction reducing means comprises a washer having a lubricating compound impregnated therein.

10. An exercise mechanism comprising:

an elongated rail;

a slide member mounted on said rail for sliding movement therealong;

brake means on said slide member adapted to provide frictional resistance to the movement of said brake means along said rail in direct proportion to the linear force applied to said slide member; and means mounted on said rail for selectively reducing the coefficient of friction between the rail and the slide member.

11. An exercise mechanism according to claim 10 wherein said coefficient of friction reducing means comprises a washer having a lubricating compound impregnated therein.

* * * * *